US009923266B1

(12) United States Patent
Casperson et al.

(10) Patent No.: US 9,923,266 B1
(45) Date of Patent: Mar. 20, 2018

(54) ANTENNA ARRAY WITH TILTED CONICAL HELICAL ANTENNAS

(71) Applicant: FIRST RF Corporation, Boulder, CO (US)

(72) Inventors: Andrew L. Casperson, Boulder, CO (US); Brandon J. Aldecoa, Denver, CO (US)

(73) Assignee: FIRST RF Corporation, Boulder, CO (US)

( * ) Notice: Subject to any disclaimer, the term of this patent is extended or adjusted under 35 U.S.C. 154(b) by 0 days.

(21) Appl. No.: 14/572,734

(22) Filed: Dec. 16, 2014

Related U.S. Application Data

(60) Provisional application No. 61/916,416, filed on Dec. 16, 2013.

(51) Int. Cl.
*H01Q 1/36* (2006.01)
*H01Q 21/00* (2006.01)

(52) U.S. Cl.
CPC ..... *H01Q 1/362* (2013.01); *H01Q 21/00* (2013.01)

(58) Field of Classification Search
CPC H01Q 1/36; H01Q 9/27; H01Q 1/362; H01Q 21/00
USPC ..... 343/895
See application file for complete search history.

(56) References Cited

U.S. PATENT DOCUMENTS 3,587,106 A * 6/1971 Crooks, Jr. ..... H01Q 11/083 343/739
3,795,005 A * 2/1974 Monser ..... H01Q 11/083 342/371
4,945,363 A 7/1990 Hoffman
5,329,287 A 7/1994 Strickland
5,604,972 A 2/1997 McCarrick
5,874,927 A * 2/1999 Knowles ..... H01Q 21/067 343/844
5,914,697 A 6/1999 Seki
6,181,296 B1 1/2001 Kulisan et al.
6,608,604 B1 8/2003 Sharaiha et al.
7,050,019 B1 5/2006 Jacomb-Hood et al.
7,286,099 B1 10/2007 Lier et al.
7,944,404 B2 5/2011 Yun et al.
2002/0149521 A1* 10/2002 Hendler ..... H01Q 1/38 343/700 MS
2013/0342397 A1* 12/2013 Turbiner ..... H01Q 3/26 342/368

OTHER PUBLICATIONS

Lin et al., High Gain Axial-Mode Helical Antenna with Circular Metal Disk, Progress in Electromagnetics Research C, 2011, pp. 15-25, vol. 23.

* cited by examiner

*Primary Examiner* — Dieu H Duong
(74) *Attorney, Agent, or Firm* — Christopher J. Kulish

(57) ABSTRACT

The invention is directed to an antenna array comprised of conical helical antennas with at least one of the antennas being a tilted conical helical antenna. In one embodiment, a tilted conical helical antenna in the array comprises an electrically conductive wire that follows a helical path on a frustum of an oblique elliptical cone in which the axis of the cone is tilted relative to the planar base surface of the cone (i.e., not perpendicular or parallel to the surface) in a plane defined by the axis and a phase center axis of the array. Each of the tilted conical helical antennas in an array is spaced from the phase center axis of the array. The degree of tilt increases the farther an antenna is located from phase center axis.

24 Claims, 10 Drawing Sheets

Array of Right Conical Helical Antennas
Short conical helix

Array of Tilted Conical Helical Antennas
Oblique helix

ANTENNA ARRAY WITH TILTED CONICAL HELICAL ANTENNAS

FIELD OF THE INVENTION

The invention relates to antennas and, more specifically, to an antenna array that employs at least one tilted conical helical antenna.

BACKGROUND OF THE INVENTION

Generally, a tapered or conical helical antenna comprises an electrically conductive wire that follows a helical path on a lateral surface of a cone or frustum of a cone. With reference to FIG. 1A, a cone 10 is defined by a planar base surface 12 and a lateral surface 14 that is, in turn, defined as the locus of all straight line segments connecting an apex 16 and the perimeter of the planar base surface 12. The perimeter of the planar base surface is elliptical. In FIG. 1A, the perimeter of the planar base surface 12 is a circle, which is a particular type of ellipse having an eccentricity of zero. The circle has a radius of $r_b$ and a center 18. The cone 10 also has a rotational axis of symmetry 20 (hereinafter "axis 20") that is defined as a line that passes through the apex 16 and the center 18 of the circular planar base surface 12. In FIG. 1A, the axis 20 is perpendicular to the planar base surface 12. The cone 10 is commonly referred to as a right circular cone with "right" referring to the angle between the planar base surface 12 and the axis 18 and "circular" referring to the shape of the perimeter of the planar base surface 12.

With reference to FIG. 1B, a frustum of a right circular cone 22 is illustrated. The frustum of a cone 22 is defined by a planar base surface 24, a lateral surface 26, and a planar top surface 28 that is parallel to the planar base surface 24. The perimeter of the planar base surface 24 is an ellipse and, in this example, a circle of radius $r_b$ with a base center 30. The perimeter of the planar top surface 28 is also an ellipse and, in this example, a circle of radius $r_t$ with a top center 32. The lateral surface 26 is defined as the locus of all straight line segments connecting the perimeter of the base surface 24 to the perimeter of the top surface 28 that, if extended, would pass through an imaginary apex 34. The frustum of a cone 22 has a rotational axis of symmetry 36 (hereinafter "axis 36") that passes through the imaginary apex 34, the base center 30 of the circular planar base surface 24, and the top center 32 of the circular planar top surface 28. In FIG. 1B, the axis 36 is perpendicular to the planar base surface 24. Since the planar base surface 24 is circular, the frustum of a cone 22 can be characterized as a frustum of a right circular cone. The frustum of a cone has a height "h" that is the perpendicular distance between the planar base surface 24 and the planar top surface 28.

With reference to FIGS. 2A and 2B, a right circular conical helical antenna 40 includes an electrically conductive wire 42 and a ground plane 44. The electrically conductive wire follows a helical path on a lateral surface 46 of a frustum of a right circular cone 48 in which a tangent to a point on the helical path makes an angle relative to the plane of the planar base surface that remains substantially constant for each point on the path. Generally, the electrically conductive wire 42 follows a helical path that begins adjacent to the planar base surface of the cone and effectively terminates before reaching the apex of the cone. As such, the electrically conductive wire follows a helical path that begins adjacent to the planar base surface of the frustum of a right circular cone 48 and effectively terminates adjacent to the planar top surface of the frustum of a right circular cone 48. It should also be appreciated that a right circular conical helical antenna does not necessarily require a cone to support the electrically conductive wire. However, the electrically conductive wire must follow a helical path as the path would exist on the lateral surface of a frustum of a right circular cone to realize a right circular conical helical antenna. The ground plane 48 typically is situated parallel to the planar base surface of the cone 48 that is used to define the helical path of the electrically conductive wire 42. A coaxial cable 50 is used to connect the conical helical antenna 40 to a transmitter and/or receiver. More specifically, the center conductor of the cable 50 extends through a hole in the ground plane 48 and is operatively connected to the end of the electrically conductive wire 42 and the outer conductor of the cable 50 is operatively connected to the ground plane 44. In a conical helical antenna comprised of two or more conductive wires (i.e., a multi-arm or multi-filar conical helical antenna), a ground plane may not be needed, as can be appreciated by those skilled in the art. Further, multi-arm or multi-filar conical helical antennas employ a balun or feed network to feed each of the arms as known by those skilled in the art.

Conical helical antennas are designed to operate in one of two modes, a normal mode in which the maximum power density is perpendicular to the rotational axis of symmetry of the cone and an axial mode in which the maximum power is in the direction of the rotational axis. In conical helical antennas that operate in the axial mode, the height of the conductor or the perpendicular distance between the planar base surface and the planar top surface of the cone on which the conductor is modeled is directly related to the gain of the antenna, i.e., the greater the height, the greater the gain. Further, the circumference of the planar base surface of the cone on which the conductor is modeled is approximately equal to the wavelength of the low-end of the bandwidth of the antenna. Similarly, the circumference of the planar top surface of the cone on which the conductor is modeled is approximately equal to the wavelength of the high-end of the bandwidth of the antenna. Typically, the angle that a tangent to the helical path makes relative to the plane defined by the planar base surface of the cone on which the conductor is modeled is approximately 12°±4° for optimal axial mode operation.

With reference to FIG. 3, an embodiment of an array of right circular conical helical antennas 54 is described. The array 54 comprises two right circular conical helical antennas 56A, 56B that are substantially identical to one another. To elaborate, the antennas 56A, 56B respectively have electrically conductive wires 58A, 58B that respectively follow identical helical paths modeled on the lateral surfaces 60A, 60B respectively associated with substantially identical cones 62A, 62B. The axes 64A, 64B respectively associated with cones 62A, 62B are substantially parallel to one another. Planar base surfaces 66A, 66B of the cones 62A, 62B lie in a plane 68. A ground plane 70 is disposed substantially parallel to the plane 68 and serves as the ground plane for both of the conical helical antennas 56A, 56B. Associated with the array 54 is a phase center axis 72 that is a line defined by phase center points at each frequency of operation for the antenna.

SUMMARY OF THE INVENTION

In one embodiment, an antenna array is provided that comprises at least two conical helical antennas that are each adapted to operate in the axial mode and with at least one of the conical helical antennas being a tilted conical helical antenna. Each of the one or more tilted conical helical antennas in the array is modeled on a frustum of an oblique cone having: (a) a planar base surface having an elliptical perimeter, (b) a planar top surface having an elliptical perimeter of lesser extent than the elliptical perimeter of the planar base surface and being substantially parallel to the planar base surface, (c) a tip axis that extends from the base surface to the top surface and, when extended from the top surface, intersects a reference axis and (d) a tip angle θ between the tip axis and the planar base surface that is not 90°. The antenna includes an electrical conductor that follows a helical path on the lateral surface of the cone model.

The tip angle of a tilted conical helical antenna is determined based on the bandwidth of the antenna and height of the antenna (i.e., the distance between the planar top and bottom surfaces). More specifically, the high and low frequencies of the bandwidth are determinative of: (a) a first distance between the reference axis and the point of intersection between the tip axis and the planar top surface and (b) a second distance between the reference axis and the point of intersection between the tip axis and the planar bottom surface, where the tip axis and the reference axis lie in the same plane and intersect one another. The first distance is less than the second distance. As such, the tilted conical helical antenna is tilted towards the reference axis. Moreover, the farther a tilted conical helical axis is from the reference axis, the greater the tilt (i.e., the smaller the tip angle between the tip axis and the planar base surface of the antenna).

In one embodiment, the tilted conical helical antenna is modeled on a frustum of an oblique circular cone, i.e., a cone with a circular planar base surface, a circular planar top surface that is substantially parallel to the circular planar bottom surface, and a tip axis extending between the centers of the circular planar top and bottom surfaces.

In another embodiment, the tilted conical helical antenna is modeled on a frustum of an oblique elliptical (not circular) cone, i.e., a cone with an elliptical planar base surface, an elliptical planar top surface that is substantially parallel to the elliptical planar bottom surface, and a tip axis that passes through the intersection of the major and minor axes of the elliptical planar base surface and the intersection of the major and minor axes of the elliptical planar top surface. Moreover, the major axes of the elliptical base and top surfaces are substantially parallel to one another and the minor axes of the elliptical base and top surfaces are substantially parallel to one another, The model upon which each of the conical helical antennas in the array is based has substantially the same base surface, top surface, and height. However, the tip angle of a model for an antenna in the array varies depending upon the distance of the antenna from the reference axis. Further, the pitch angle at any point on the helical path traversed by the electrical conductor of each of the conical helical antennas in the array remains substantially constant and is substantially the same for each of the antennas in the array. The pitch angle is the angle between a tangent at any point on the helical path followed by the electrical conductor and the plane of the planar base surface. Further, the "handed-ness" (right-hand or left-handed) of the electrical conductor in each of the antennas is the same.

However, assuming that all the antennas are to be fed in phase, the point of the base surface at which the end of the electrical conductor of the antenna is located can vary depending on the location of the antenna relative to the reference axis. For example, several antennas located at the same distance from the reference axis will be modeled on the same cone with a tip angle commensurate with the distance of the antennas from the reference axis. Although the tip axis of each of the antennas will be coplanar with the reference axis, the tip axis of each of the antennas will be at a different azimuthal location relative to the reference axis. Further, to feed each of the antennas in phase, the end of each of the electrical conductors must be substantially at the same azimuthal location relative to the point at which the tip axis intersects the planar base surface of the antenna. Due to the different azimuthal locations of the antennas relative to the reference axis and the end of each of the electrical conductors needing to be at substantially the same azimuthal location relative to the point at which the tip axis intersects the planar base surface of each antenna, each of the antennas in this example is unique as to where the end of the electrical conductor is located. In certain embodiments of the array, the need for each antenna being unique with respect to the location of the end of the electrical conductor adjacent to the planar base plate is reduced by including a phase shifter in the antenna.

If the array incorporates a non-tilted conical helical antenna (i.e., a conical helical antenna modeled on a frustum of a right elliptical cone), the antenna will have a tip axis that is collinear with the reference axis and at 90° to the plane of the planar base surface.

The invention is directed to an antenna array comprised of tilted conical helical antennas that each operate in an axial mode and are each laterally spaced from a reference axis of the array. To appreciate the various approaches to realizing a tilted conical helical antenna, a reference antenna that is a non-tilted conical helical antenna (e.g., the conical helical antenna modeled on a right circular cone and illustrated in FIGS. 2A and 2B) with the desired radiative properties (gain, bandwidth, pattern etc.) is assumed to exist and be located at the reference axis of the array. Such an antenna may or may not be present in the actual array. Each of the tilted conical helical antennas in the array comprises an electrically conductive wire that follows a helical path modeled on a frustum of an oblique elliptical cone in which: (a) the elliptical perimeter of the planar top surface is substantially identical to the elliptical perimeter of the planar top surface of the reference antenna, (b) the elliptical perimeter of the planar base surface is substantially identical to the elliptical perimeter of the planar base surface of the reference antenna, and (c) the axis of the cone is tilted relative to the planar base surface of the cone (i.e., not perpendicular to the planar base surface) in a plane defined by the cone axis and a reference axis of the array. Each of the tilted conical helical antennas is spaced from the reference axis of the array. The degree of tilt increases the farther an antenna is located from reference axis. For example, in a linear antenna array of four tilted conical helical antennas each modeled on a frustum of an oblique circular cone and centered about a reference axis, the distance between the centers of consecutive planar top surfaces of diameter "a" is maintained at a distance d1 and the distance between the centers of consecutive planar bottom surfaces of diameter "b" is maintained at a distance d2, which is greater than d1. The distances d1 and d2 are related to one another such that the distance d2 is equal to $(f_h/f_l)$*d1, where $f_h$ defines the high frequency end of the bandwidth and $f_l$ defines the low frequency end of the bandwidth. As such, the two tilted conical helical antennas at the ends of the array have a greater tilt relative to their planar base surface than the two tilted conical helical antennas located intermediate to the two end antennas. The helical path that the electrically conductive wire follows on tilted conical helical antennas has the same pitch angle as the path followed by the electrically conductive wire on the reference antenna, i.e., a tangent at any point on the helical path has an pitch angle relative to the plane of the planar base surface that remains substantially constant and is substantially equal to the corresponding angle associated with the reference antenna.

DETAILED DESCRIPTION

The invention is directed to an antenna array comprised of at least two conical helical antennas that each operate in an axial mode and with at least one of the antennas being a tilted conical helical antenna that is laterally spaced from a reference axis, which is commonly the phase center axis of the array. The array provides a more constant gain and constant radiation pattern over a frequency band than presently known arrays of helical antennas operating over the same frequency band. Further, in many situations, the antenna array has a lower height profile than presently known arrays of helical antennas that otherwise have comparable performance criteria.

Figure 1A:
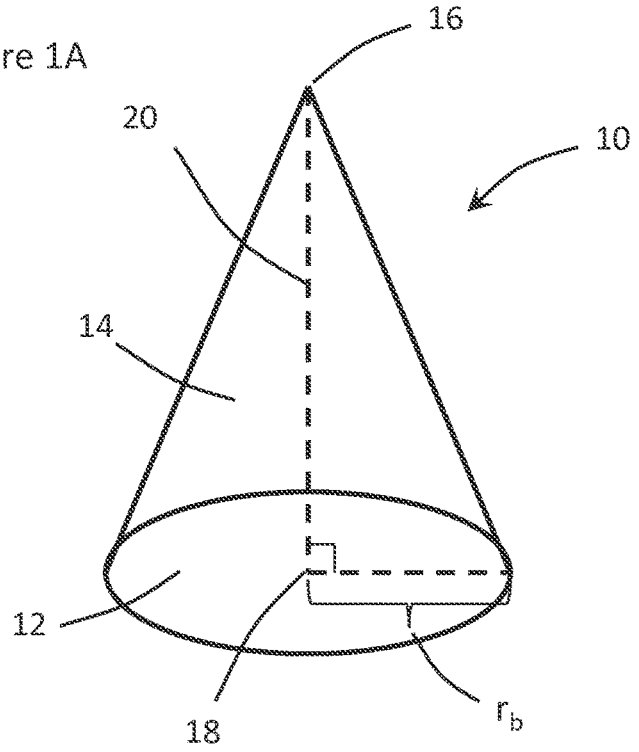
FIG. 1A is a perspective view of a right circular cone.
Figure 1B:
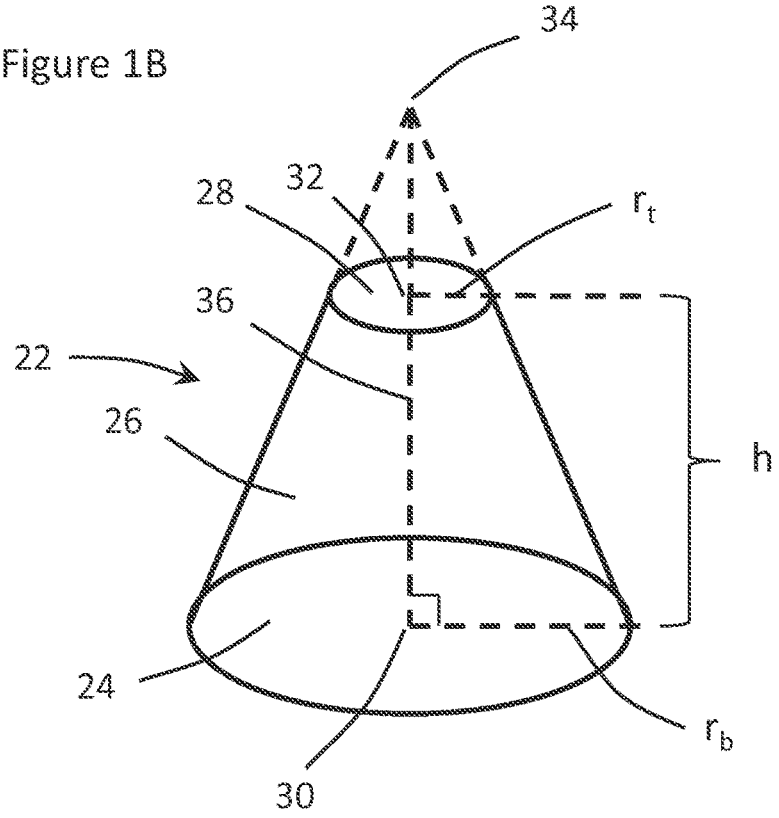
FIG. 1B is a perspective view of a frustum of a right circular cone.
Figure 2A:
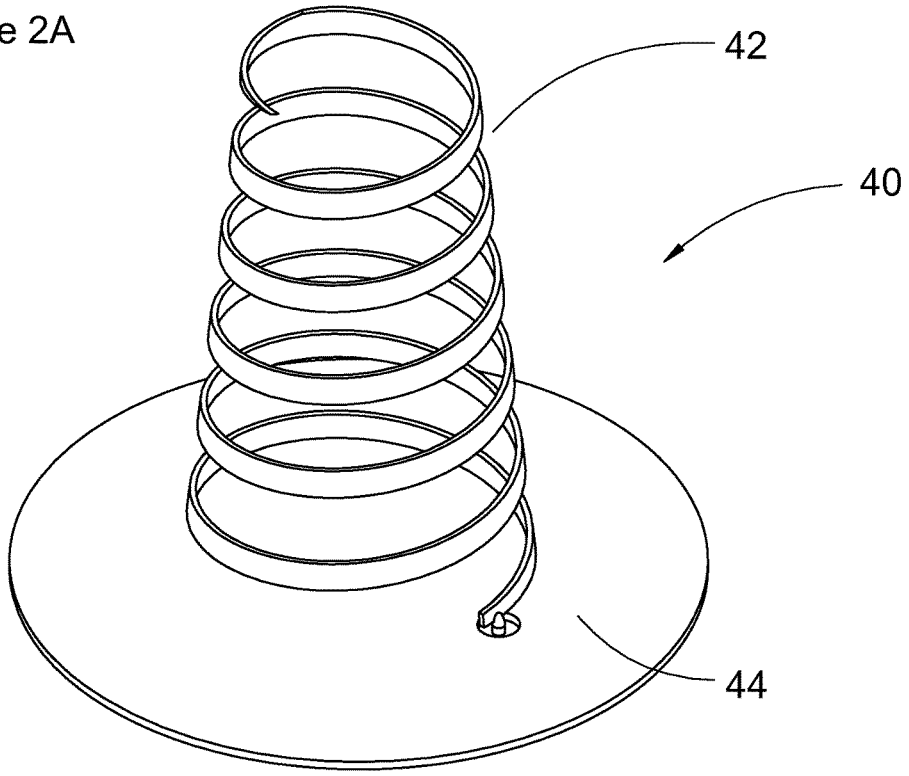
FIG. 2A is a perspective view of a conical helical antenna.
Figure 2B:
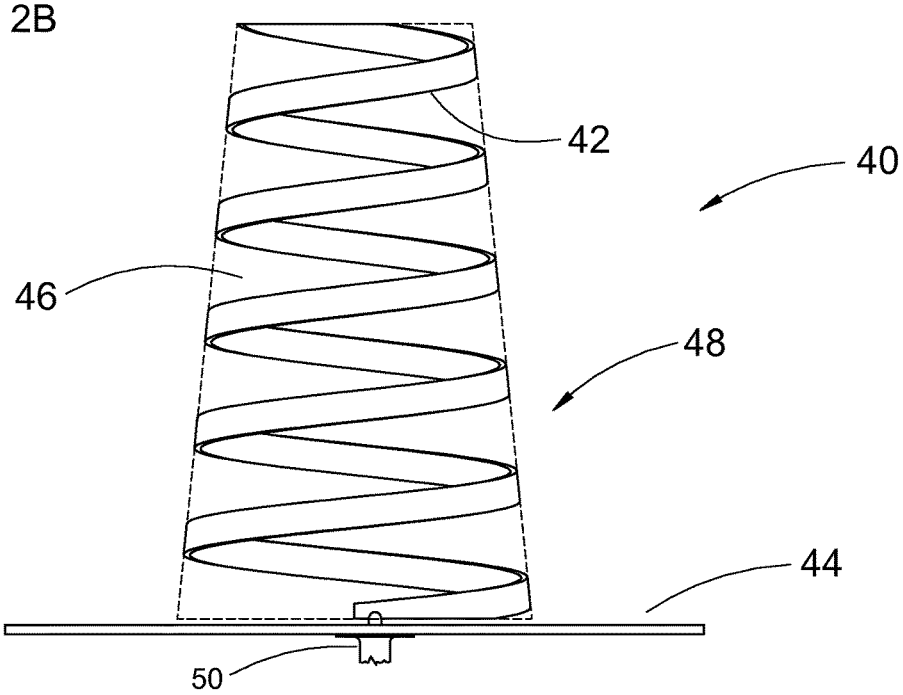
FIG. 2B is a side view of the conical helical antenna shown in FIG. 2A that also shows the frustum of a right circular cone that is used to define the helical path followed by the conductor of the antenna.
Figure 3:
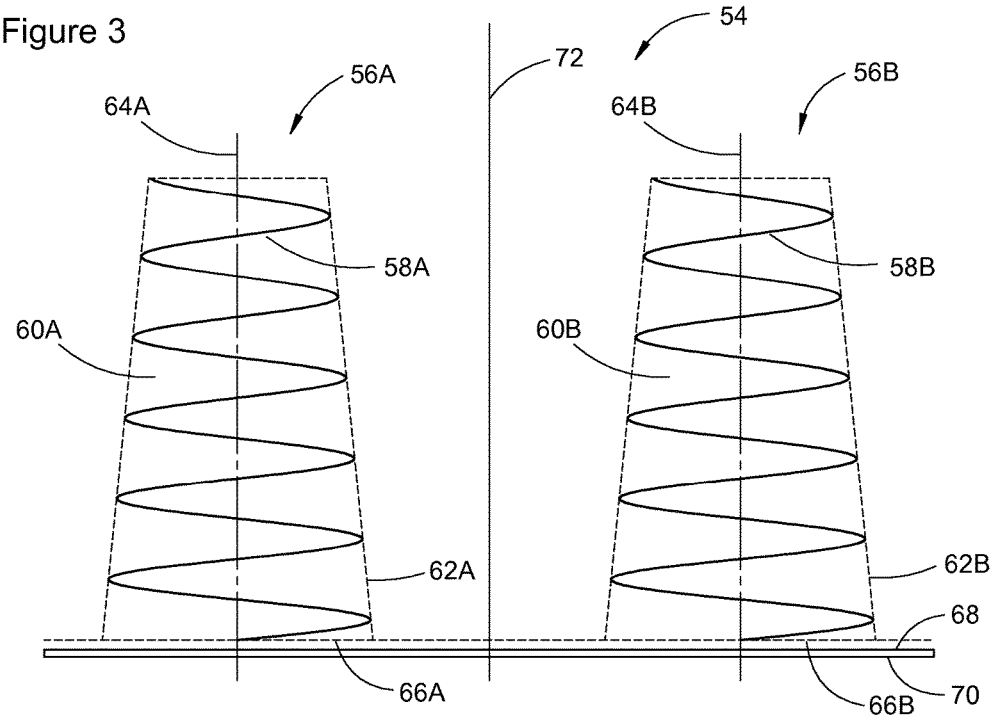
FIG. 3 illustrates an embodiment of a known type of array of conical helical antennas.
Figure 4:
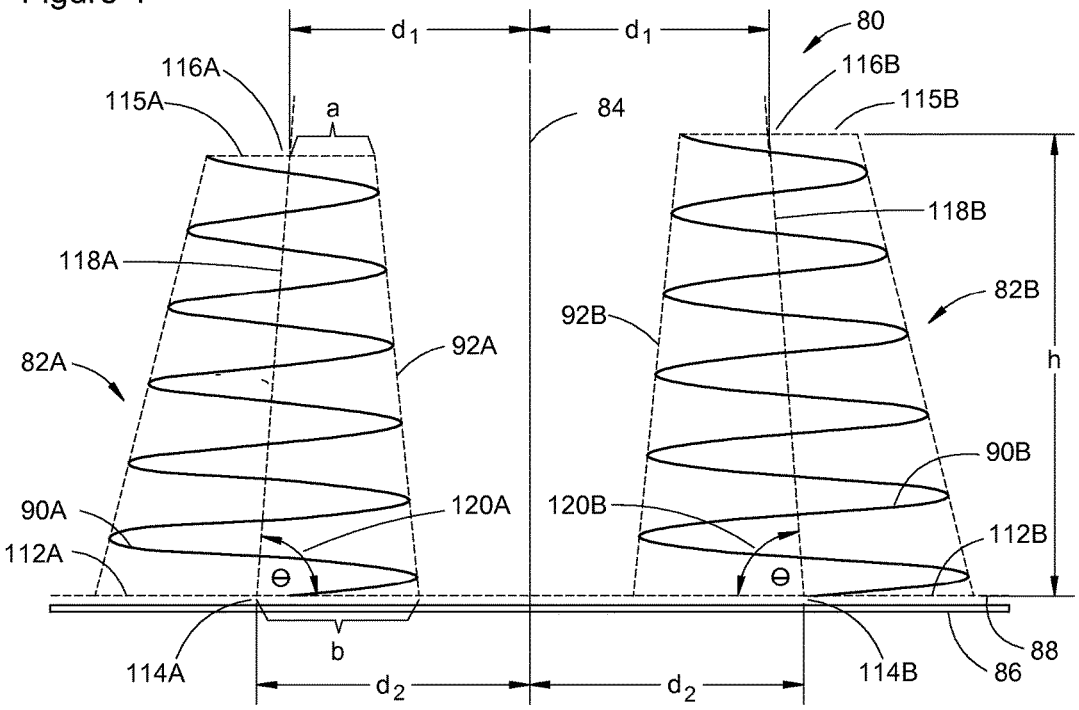
FIG. 4 illustrates a linear antenna array of two tilted conical helical antennas in which the electrically conductive wire associated with each of the antennas follows a helical path on the lateral surface of an oblique circular cone.

With reference to FIG. 4, an embodiment of an antenna array of tilted conical helical antennas 80 (hereinafter referred to as "array 80") is described. The array 80 is a linear array in which lines that connect corresponding locations on the tilted conical helical antennas are straight lines that are substantially parallel to one another. The array comprises first and second tilted conical helical antennas 82A, 82B. The first and second tilted conical helical antennas 82A, 82B are each laterally spaced from a phase center axis 84. The array 80 further includes a ground plane 86 that serves as a ground plane for both of the antennas 82A, 82B and is located substantially parallel to a plane 88 that includes the planar base surfaces of the cones on which the electrically conductive wires of the antennas 82A, 82B are modeled. Typically, the positional relationship of the tilted conical helical antennas 82A, 82B relative to the ground plane 86 is maintained by a dielectric support structure that extends between the ground plane 86 and the antennas 82A, 82B. While the array 80 does not include a reference antenna located at the phase center axis 84, the non-tilted conical helical antenna 40 shown in FIGS. 2A and 2B will be considered a reference antenna for purposes of describing the first and second tilted conical helical antennas 82A, 82B.

The first and second tilted conical helical antennas 82A, 82B are respectively comprised of electrically conductive wires 90A, 90B that respectively follow helical paths modeled on frustums of oblique circular cones 92A, 92B.

Figure 5A:
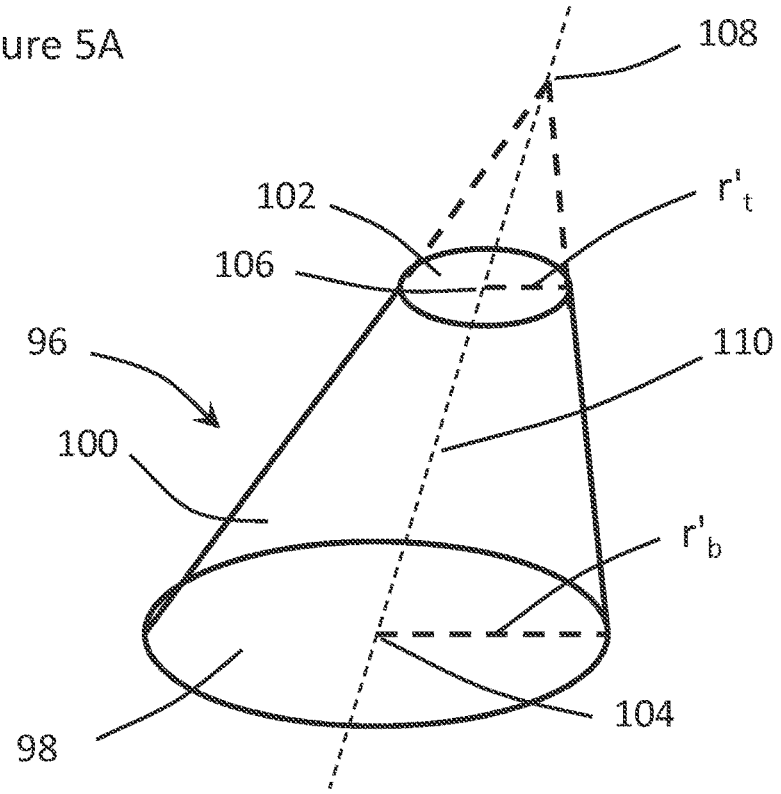
FIGS. 5A and 5B respectively illustrate perspective and side views of a frustum of an oblique circular cone.
Figure 5B:
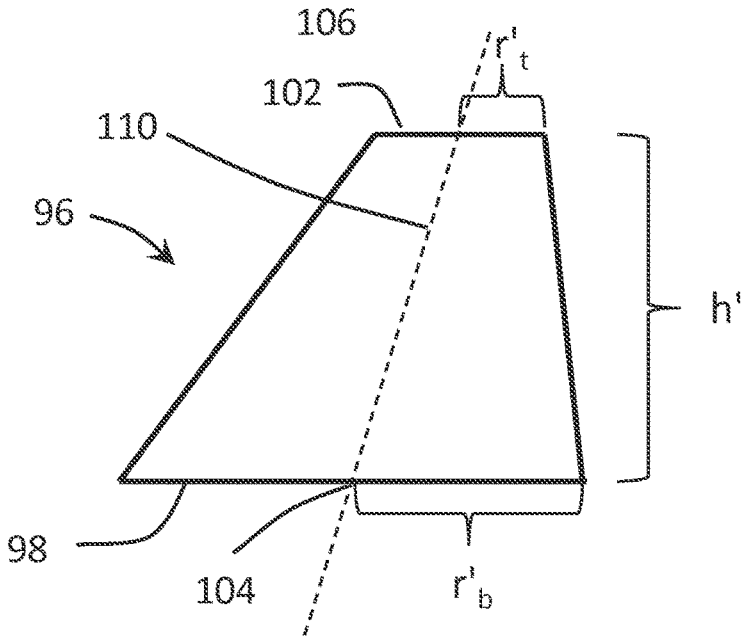

With reference to FIGS. 5A and 5B, a frustum of an oblique elliptical cone and, more specifically, a frustum of an oblique circular cone 96 is described. The frustum 96 is defined by a planar base surface 98, a lateral surface 100, and a planar top surface 102 that is parallel to the planar base surface 98. The perimeter of the planar base surface 98 is an ellipse and, in this example, a circle of radius $r'_b$ with a base center 104. The perimeter of the planar top surface 102 is also an ellipse and, in this example, a circle of radius $r'_t$ with a top center 106. The lateral surface 100 is defined as the locus of all straight line segments connecting the perimeter of the base surface 98 to the perimeter of the top surface 102 that, if extended, would pass through an imaginary apex 108. The frustum 96 has a tip axis 110 that passes through the imaginary apex 108, the base center 104 of the circular planar base surface 98, and the top center 106 of the circular planar top surface 102. The tip axis 110 is oblique to the planar base surface 98, i.e., neither perpendicular nor parallel to the planar base surface 98. Since the planar base surface 98 is circular and the tip axis 110 is oblique, the frustum is characterized as a frustum of an oblique circular cone. The frustum 98 has a height h' that is the perpendicular distance between the planar base surface 98 and the planar top surface 102.

With reference to FIG. 4, the electrically conductive wires 90A, 90B respectively follow helical paths on the lateral surfaces of the oblique circular cones 92A, 92B. Each of the helical paths has a first terminus immediately adjacent to the planar base surface of the frustum, a second terminus adjacent to the planar top surface, and between the first and second termini follows a helical path on the lateral surface. Characteristic of a helical path is that a tangent to any point on the path makes an angle relative to the planar base surface and this angle is substantially the same for each point on the path. This angle is referred to as the pitch angle. Typically, the pitch angle is 12°±4° and, in any event, substantially equal to the pitch angle associated with the reference antenna 40. It should be appreciate that variations in the pitch angle of an electrically conductive wire may be employed to enhance performance of an antenna at certain portions of the bandwidth. It should be appreciated that the electrically conductive wires 90A, 90B have substantially constant cross-sectional profiles throughout their lengths. Further, a number of cross-sectional profiles are typically feasible for a particular application, including circular and rectangular. Further, the "handed-ness" (right-hand or left-hand) of each of the helical paths 90A, 90B is the same.

The frustums 96A, 96B associated with first and second tilted conical helical antennas 82A, 82B have: (a) heights that are substantially equal to the height of the frustum on which the reference antenna 40 is modeled, (b) radiuses for the planar base surfaces that are substantially equal to the radius of the planar base surface of the frustum on which reference antenna 40 is modeled, and (c) radiuses for the planar top surfaces that are substantially equal to the radius of the planar top surface of the frustum on which reference antenna 40 is modeled. The electrically conductive wires 90A, 90B have the same pitch angles and handed-ness as the reference antenna 40. Additionally, because the heights, radiuses, pitch angles, and handed-ness associated with the first and second tilted conical helical antennas 82A, 82B are substantially equal to the heights, radiuses, pitch angles, and handed-ness of the reference antenna 40, the electrically conductive wires 90A, 90B have substantially the same number of turns as the electrically conductive wire associated with the reference antenna 40. As such, the first and second tilted conical helical antennas 82A, 82B have gains, bandwidths, and other radiation characteristics that are substantially equal to the gain, bandwidth, and other radiation characteristics of the reference antenna 40.

With reference to FIG. 4, the frustums 92A, 92B on which the first and second tilted conical helical antennas 82A, 82B are modeled respectively have circular planar base surfaces 112A, 112B with base centers 114A, 114B and radius "b", circular planar top surfaces 115A, 115B with top centers 116A, 116B and radius "a", heights "h", and tip axes 118A, 118B. The first and second tilted conical helical antennas 82A, 82B are oriented such that: (a) the phase center axis 84 and tip axes 118A, 118B define a plane and (b) the phase center axis 84 is located between the tip axes 118A, 118B. The tip axes 118A, 118B respectively make oblique angles (A) 120A, 120B relative to plane 88 that are determined by the perpendicular distances (d1) of the top centers 116A, 116B from a reference location, the perpendicular distances (d2) of the base centers 114A, 114B from the reference location, and the ratio of the planar base surface radius to the planar top surface radius (b/a) or equivalently the ratio of the high frequency ($f_l$) and low frequency ($f_h$) that define the bandwidth of the antenna. It should be appreciated that $f_l$ and $f_h$ are each based on a wavelength-to-circumference relationship for the relevant planar surface. However, $f_l$ and $f_h$ can vary based on a variety of performance parameters, such as impedance match, axial ratio, and other performance parameters known to those skilled in the art. Specifically, the relationship of the distances d1 and d2 relative to a reference location is expressed by the following equation:

$$d2=(f_h/f_l)*d1 \quad (1)$$

For purposes of illustration, the reference location is chosen to be the phase center axis 84. By choosing either the distance "d1" of the planar top center 116A from the phase center axis 84 or the distance "d2" of the planar base centers from the phase center axis 84, the other of the two distances from the phase center axis 84 can be calculated according to the noted formula. Since the tip axis 118A passes through the planar base center 114A and the planar top center 116A and the distances of the centers from the phase center axis 84 are known, the angle is determined according to the following equation:

$$\theta=\tan^{-1}(h/(d2-d1)) \quad (2)$$

Figure 4A:
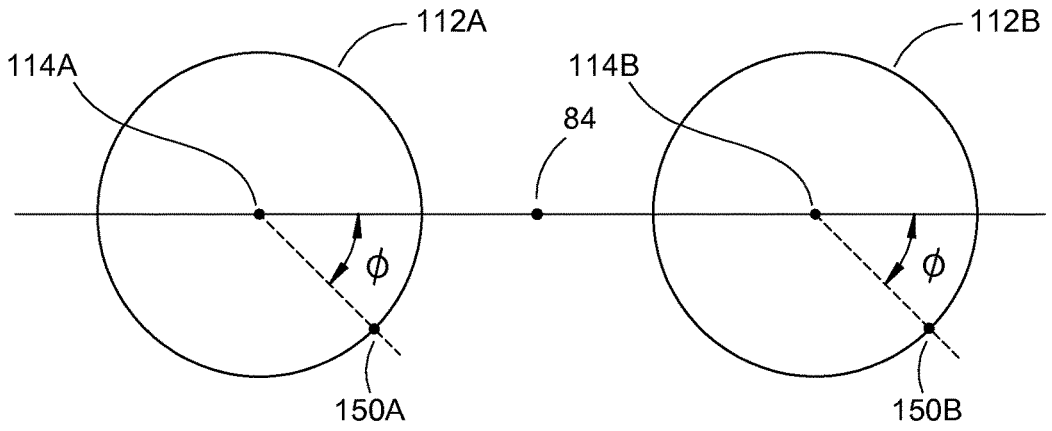
FIG. 4A illustrates the locations at which the tilted conical helical antennas shown in FIG. 4 are feed so as to feed the antennas in phase but resulting in the electrically conductive wires associated with the two antennas being structurally unique.

With reference to FIG. 4A, to feed each of the first and second conical helical antennas 82A, 82B in phase, the end 150A of the electrically conductive wire 90A of antenna 82A is located at an azimuthal angle φ relative to the base center 114A and the end 150B of the electrically conductive wire 90B of antenna 82B is located at substantially the same azimuthal angle φ relative to the base center 114B. Even though the antennas 82A, 82B are modeled on the same oblique cone, the location of the antennas on opposite sides of the of the phase center axis 84 and the ends 150A, 150B of the antennas being located at substantially the same azimuthal angles φ relative to the base centers 114A, 114B results in the electrically conductive wires 90A, 90B of the two antennas 82A, 82B being structurally unique relative to one another.

Figure 4B:
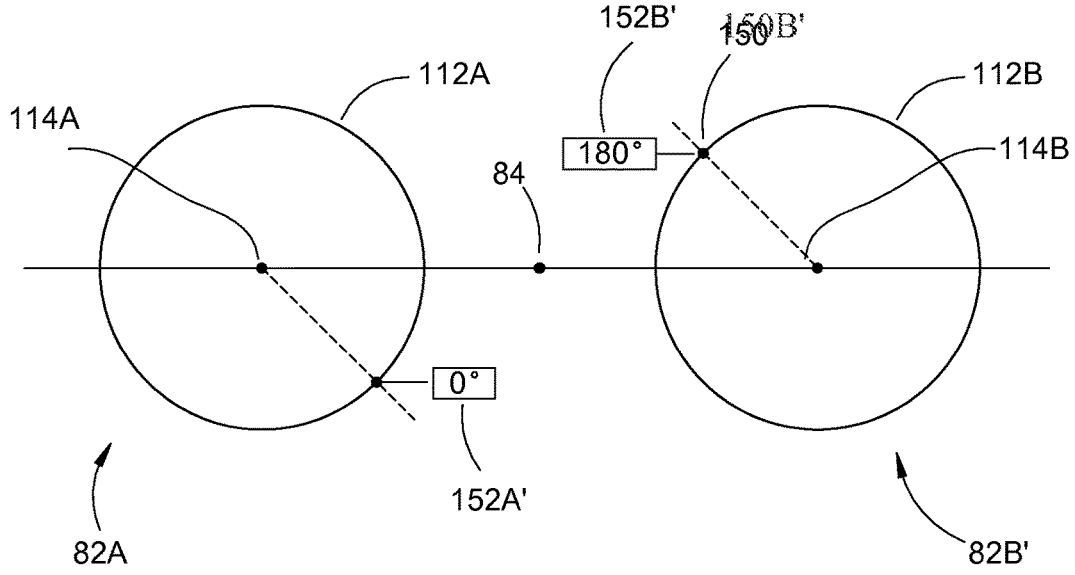
FIG. 4B illustrates the use of two tilted conical helical antennas that employ electrically conductive wires that are substantially structurally identical and that employ phase shifters to feed the antennas in phase.

The need to construct two structurally unique antennas for conical helical antennas in a linear array that are symmetrically disposed about a reference axis and, as such, are modeled on the same oblique cone can be avoided by incorporating phase shifters into the antennas. With reference to FIG. 4B, a second conical helical antenna 82B' is provided that is substantially identical to the conical helical antenna 82A. As such, the end 150B' of the electrically conductive wire of the second conical helical antenna 82B' (which is structurally identical to wire 90A of the first conical helical antenna 82A) is shifted 180° relative to the end 150B of the electrically conductive wire 90B of the conical helical antenna 82B (FIG. 4A). Without more, this 180° shift in the location of the end of the 150B' of the electrically conductive wire 90B' will result in the first conical helical antenna 82A and the second conical helical antenna 82B' being out of phase with one another. To address this phase issue, a 180° phase shifter 152B' is incorporated into the second conical helical antenna 82B'. For clarity, a 0° phase shifter 152A' is incorporated into the first conical helical antenna 82A.

While the array 80 is a linear array of tilted conical helical antennas 80 in which the two tilted conical helical antennas are each disposed the same distance from the phase center axis 84 (i.e., symmetrically about the phase center axis 84) and have substantially the same tip angle θ, a number of other linear arrays are feasible. Among these other linear arrays are: (1) a symmetrical linear array with more than two tilted conical helical antennas disposed on each side of the phase center axis (or other reference axis) and (2) an asymmetrical linear array with an unequal number of tilted conical helical antennas are disposed to each side of a reference axis, including an asymmetrical linear array in which all of the tilted conical helical antennas are disposed to one side of a reference axis. Regardless of the type of linear array that incorporates two or more tilted conical helical antennas, the distances $d_1$ and $d_2$ and the tilt angle θ for each of the tilted conical helical antennas in the array can be determined if at least one of $d_1$ and $d_2$ and the height "h" is known.

The tilted conical helical antennas in a linear array can be tilted elliptical (but not circular) conical helical antennas. A tilted elliptical conical helical antenna is modeled on a frustum of an elliptical conical cone with an elliptical planar base surface, an elliptical planar top surface that is substantially parallel to the elliptical planar base surface and of a lesser extent than the elliptical planar base surface, and a height "h" between the planes of the elliptical planar base and top surfaces. Further, each of the elliptical planar base and top surfaces has a major and minor axis with the major axes of the elliptical planar base and top surfaces being substantially parallel to one another and the minor axes of the elliptical planar base and top surfaces being substantially parallel to one another. The tip axis of a tilted elliptical conical helical antenna is a line that extends through the intersection point of the major and minor axes of the elliptical planar base surface and the intersection point of the major and minor axes of the elliptical planar top surface. In a linear array that incorporates two or more tilted elliptical conical helical antennas, major axes of the elliptical planar base and top surfaces of each of the tilted elliptical conical helical antennas are substantially parallel to one another and the minor axes of the elliptical planar base and top surface of each of the tilted elliptical conical helical antennas are substantially parallel to one another. The tilt axes of each of the elliptical conical helical antennas and the reference axis lie in plane.

Also feasible is a linear array of conical helical antennas with at least one tilted conical helical antenna. Such a linear array may incorporate a non-tilted conical helical antenna (e.g. right conical helical antenna 40, which has a tilt angle θ of 90°) located such that the tilt axis is collinear with reference axis.

A two-dimensional array comprised of at least three conical helical antennas with at least two of the conical helical antennas being tilted conical helical antennas is feasible.

Figure 4C:
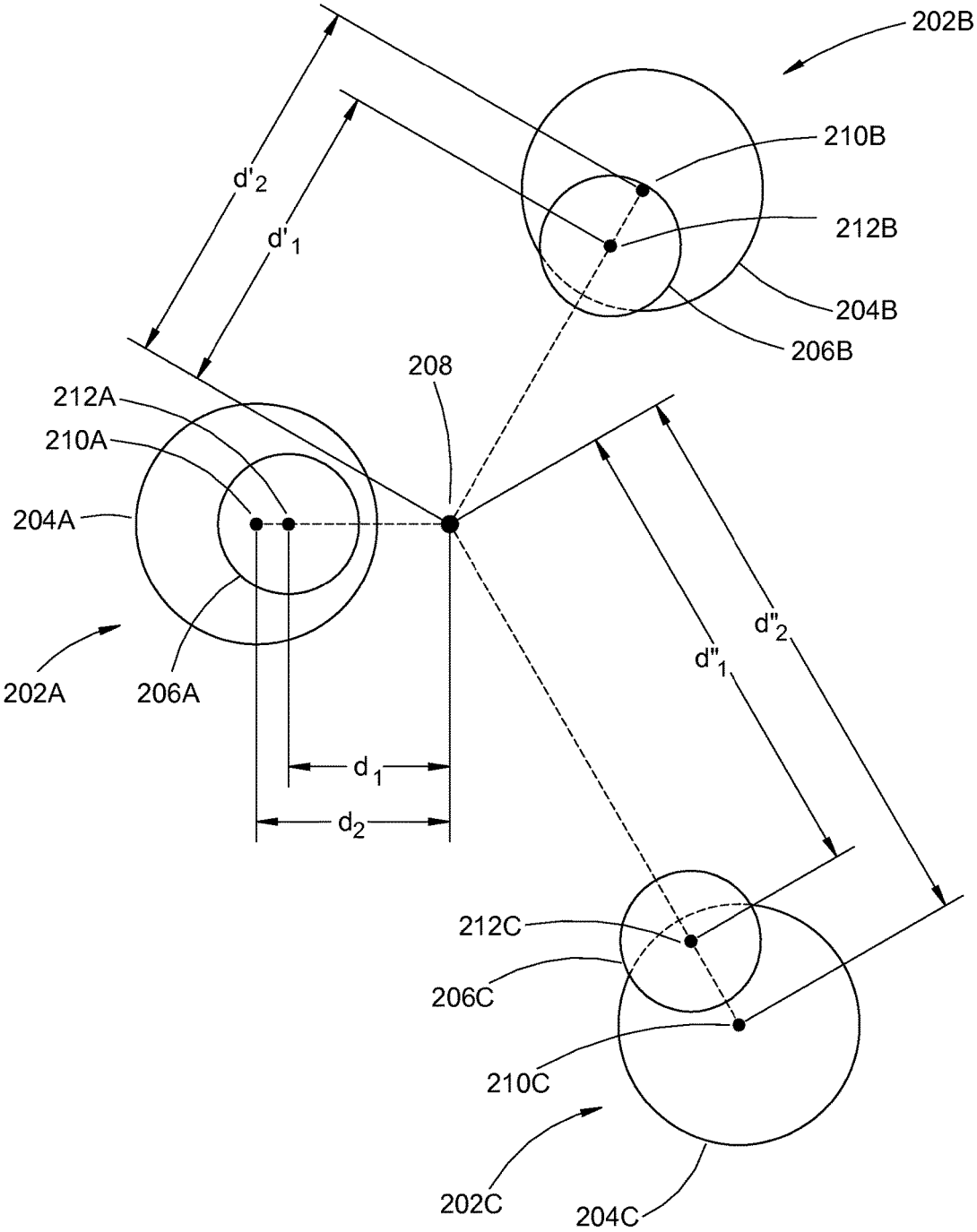
FIG. 4C illustrates a two dimensional array of tilted conical helical antennas.

With reference to FIG. 4C, a two-dimensional array of conical helical antennas 200 (hereinafter "array 200") is described. The array 200 comprises three tilted circular conical helical antennas 202A-202C. The tilted circular conical helical antennas 202A-202C are modeled on a frustums of oblique circular cones that respectively have circular planar base surfaces 204A-204C that lie in a plane that is spaced from and parallel to a ground plane (not shown), circular planar top surfaces 206A-206C that are each substantially parallel to the corresponding one of the circular planar base surfaces 204A-204C, and a height "h" that is the same for each cone. The tilt angle θ of each of the cones is different due to each of the antennas 202A-202C being located at a different distances from a reference axis 208. More specifically, tilted circular conical helical antenna 202A has a base center 210A and a top center 212A that are respectively located at distances $d_2$ and $d_1$ from the reference axis 208; tilted circular conical helical antenna 202B has a base center 210B and a top center 212B that are respectively located at distances $d_2'$ and $d_1'$ from the reference axis 208; and tilted circular conical helical antenna 202C has a base center 210C and a top center 212C that are respectively located at distances $d_2''$ and $d_1''$ from the reference axis 208. While the distances $d_1$, $d_1'$, and $d_1''$ are different from one another and the distances $d_2$, $d_2'$ and $d_2''$ are different from one another, the distances associated with each of the antennas 202A-202C conform to Equation 1. Moreover, because the lateral distance between the base center 210A and the top center 212A of the antenna 202A ($d_2-d_1$) is less than the lateral distance between the base center 210B and the top center 212B of the antenna 202B ($d_2'-d_1'$), the tip angle θ of the antenna 202A is greater (i.e., closer to 90°) than the tip angle θ of the antenna 202B. Similarly, because the lateral distance between the base center 210B and the top center 212B of the antenna 202B ($d_2'-d_1'$) is less than lateral distance between the base center 210C and the top center 212C of the antenna 202C, the tip angle θ of the antenna 202B is greater than the tip angle θ of the antenna 202C ($d_2''-d_1''$).

Figure 4D:
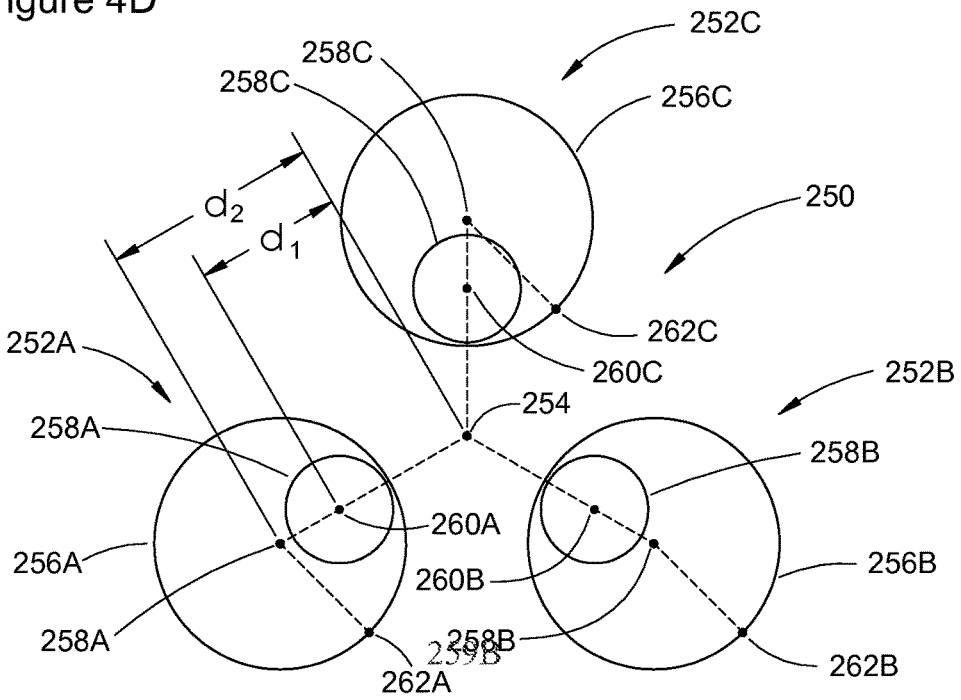
FIG. 4D illustrates the an array of three tilted conical helical antennas equidistantly spaced from a reference axis and the feed locations for the electrically conductive wires associated with each of the antennas.

With reference to FIG. 4D, a second embodiment of a two-dimensional array of conical helical antennas 250 (hereinafter "array 250") is described. The array 250 comprises three tilted circular conical helical antennas 252A-252C that are each equidistant from a reference axis 254. Because the antennas 252A-252C are equidistant from the reference axis 254, the tilted circular conical helical antennas 252A-252C are modeled on the same frustum of an oblique circular cone. The antennas 252A-252C respectively have circular planar base surfaces 256A-256C that lie in a plane that is spaced from and parallel to a ground plane (not shown), circular planar top surfaces 258A-258C that are each substantially parallel to the corresponding one of the circular planar base surfaces 256A-256C, and a height "h". The tilt angle θ of each of the cones is the same due to each of the antennas 202A-202C being located at substantially the same distance from the reference axis 254. More specifically, tilted circular conical helical antenna 252A has a base center 259A and a top center 260A that are respectively located at distances $d_2$ and $d_1$ from the reference axis 254; tilted circular conical helical antenna 252B has a base center 259B and a top center 260B that are respectively located at distances $d_2'$ and $d_1'$ from the reference axis 254; and tilted circular conical helical antenna 252C has a base center 259C and a top center 260C that are respectively located at distances $d_2''$ and $d_1''$ from the reference axis 254. The distances $d_1$, $d_1'$, and $d_1''$ are substantially the same and the distances $d_2$, $d_2'$ and $d_2''$ are substantially the same. Further, the distances associated with each of the antennas 252A-252C conform to Equation 1. Moreover, because the lateral distances respectively between: (a) the base center 259A and the top center 260A of the antenna 252A ($d_2-d_1$), (b) the base center 259B and the top center 260B of the antenna 252B ($d_2'-d_1'$), and (c) base center 259C and the top center 260C of the antenna 252C ($d_2''-d_1''$) are substantially the same, the tip angles θ associated with each the antennas 252A-252C are also substantially the same. To feed the antennas 252A-252C in phase, the ends 262A-262C of the electrical conductors of the antennas respectively located adjacent to the circular planar base surfaces 256A-256C of each of the antennas is located at the same azimuthal angle φ relative to the base center 259A-259C of the relevant antenna. The locations of the ends 262A-262C of the electrical conductors for in phase feeding of the antennas 252A-252C renders the electrical conductor for each of the antennas 252A-252C structurally unique relative to the other electrical conductors.

Figure 4E:
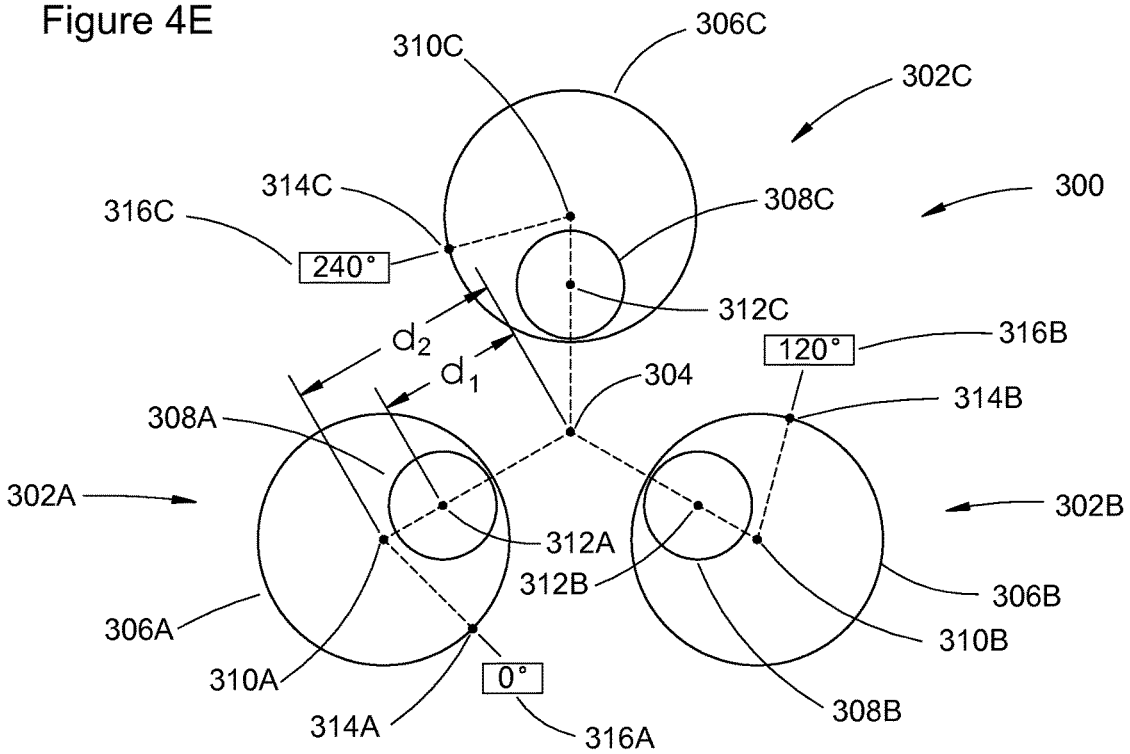
FIG. 4E illustrates the use of three tilted conical helical antennas that employ electrically conductive wires that are substantially structurally identical and that employ phase shifters to feed the antennas in phase.

The need for structurally unique electrical conductors in a two-dimensional array of conical helical antennas with two or more of the antennas equidistant from a reference axis can be substantially reduced by incorporating phase shifters into the antennas that are equidistant from the reference axis. With reference to FIG. 4E, a two-dimensional array of conical helical antennas 300 comprised of three tilted circular conical helical antennas 302A-302C that are each equidistant from a reference axis 304 is described. The antennas 302A-302C are modeled on the same frustum of an oblique circular cone. The antennas 302A-302C respectively have circular planar base surfaces 306A-306C that lie in a plane that is spaced from and parallel to a ground plane (not shown), circular planar top surfaces 308A-308C that are each substantially parallel to the corresponding one of the circular planar base surfaces 306A-306C, and a height "h". The tilt angle θ of each of the cones is the same due to each of the antennas 302A-302C being located at substantially the same distance from the reference axis 304. More specifically, tilted circular conical helical antenna 302A has a base center 310A and a top center 312A that are respectively located at distances $d_2$ and $d_1$ from the reference axis 304; tilted circular conical helical antenna 302B has a base center 310B and a top center 312B that are respectively located at distances $d_2'$ and $d_1'$ from the reference axis 304; and tilted circular conical helical antenna 302C has a base center 310C and a top center 312C that are respectively located at distances $d_2''$ and $d_1''$ from the reference axis 304. The distances $d_1$, $d_1'$, and $d_1''$ are substantially the same and the distances $d_2$, $d_2'$ and $d_2''$ are substantially the same. Further, the distances associated with each of the antennas 302A-302C conform to Equation 1. Moreover, because the lateral distances respectively between: (a) the base center 310A and the top center 312A of the antenna 302A ($d_2-d_1$), (b) the base center 310B and the top center 312B of the antenna 302B ($d_2'-d_1'$), and (c) base center 310C and the top center 312C of the antenna 302C ($d_2''-d_1''$) are substantially the same, the tip angles θ respectively associated with the antennas 302A-302C are also substantially the same. The location of the ends 314A-314C of the electrically conductive wire associated each of the antennas 302A-302C renders each of the electrically conductive wire associated with each of the antennas 302A-302C substantially identical to one another. However, the end 314B is rotated 120° relative to end 262B (See FIG. 4D) and end 314C is rotated 240° relative to the end 262C (See FIG. 4D). Without more, these 120° and 240° shifts in the locations for the ends 302B and 302C relative to the locations of ends 262B and 262C of antenna 200 will result in the antennas 302A-302C being out of phase with one another. However, this out of phase issue can be addressed by incorporating phase shifters into the antennas 302A-302C. Specifically, a 120° phase shifter 316B is incorporated into antenna 302B and a 240° phase shifter is incorporated into antenna 302C. For clarity, a 0° phase shifter 316A is incorporated into antenna 302A.

Figure 4G:
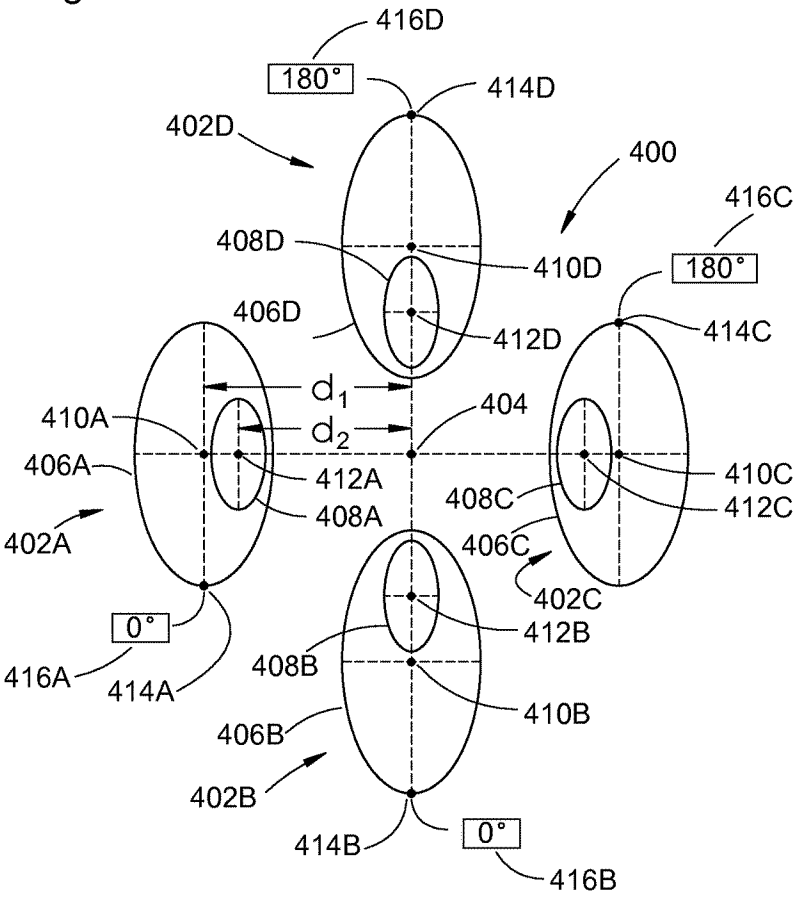
FIG. 4G illustrates the use of four tilted elliptical conical helical antennas that employs pairs of electrically conductive wires that are substantially structurally identical and that employ phase shifters to feed the antennas in phase.
Figure 4F:
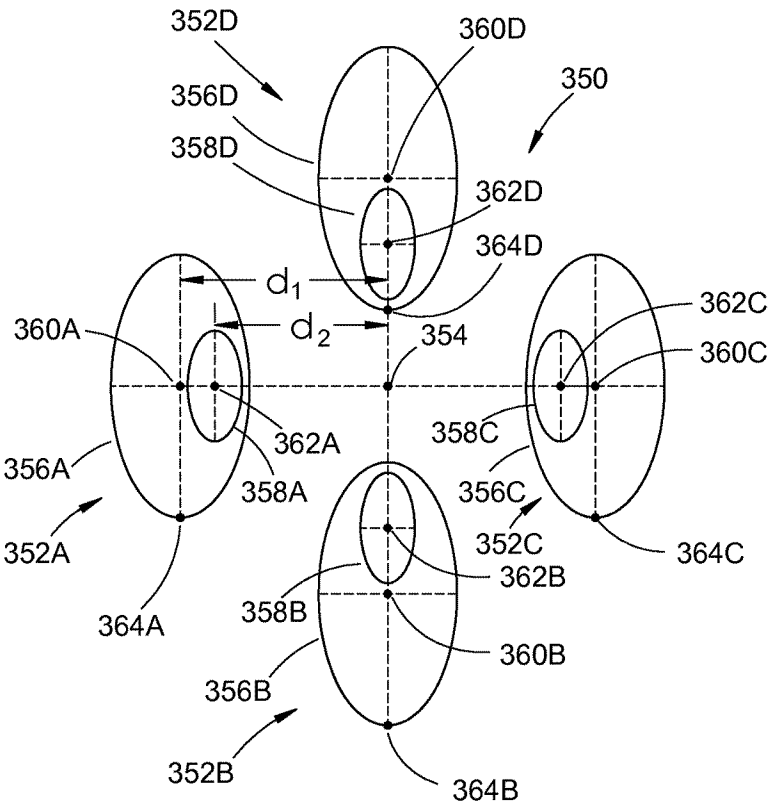
FIG. 4F illustrates the an array of four tilted elliptical conical helical antennas equidistantly spaced from a reference axis and the feed locations for the electrically conductive wires associated with each of the antennas.

With reference to FIG. 4F, a third embodiment of a two-dimensional array of conical helical antennas 350 (hereinafter "array 350") is described. The array 350 comprises four tilted elliptical conical helical antennas 352A-352D that are each equidistant from a reference axis 354. Because the antennas 352A-352D are equidistant from the reference axis 354, the tilted elliptical conical helical antennas 352A, 352C are modeled on a first frustum of an oblique elliptical cone and tilted helical antennas 352B, 352D are modeled on a second frustum of an oblique elliptical cone. The antennas 352A-352D respectively have elliptical planar base surfaces 356A-356D that lie in a plane that is spaced from and parallel to a ground plane (not shown), elliptical planar top surfaces 358A-358D that are each substantially parallel to the corresponding one of the elliptical planar base surfaces 356A-356D, and a height "h". Each of the frustums is such that: (a) the major axis of each of the elliptical planar base surfaces 356A-356D is substantially parallel to the major axis of the corresponding one of the elliptical planar top surfaces 358A-358D and (b) the minor axis of each of the elliptical planar base surfaces 356A-356D is substantially parallel to the minor axis of the corresponding one of the elliptical planar top surfaces 358A-358D. Each of antennas 352A-352D is situated such that: (a) the major axes associated with the base and top elliptical planar surfaces of each antenna are parallel to the major axes associated with the base and top elliptical planar surfaces of each of the other antennas and (b) the minor axes associated with the base and top elliptical planar surfaces of each antenna are parallel to the minor axes associate with the base and top elliptical planar surfaces of each of the other antennas. The tilt angle θ of each of the cones is the same due to each of the antennas 352A-352D being located at substantially the same distance from the reference axis 354. More specifically, tilted elliptical conical helical antenna 352A has a base center 360A (i.e., the intersection of the major and minor axes of the ellipse) and a top center 362A (i.e., the intersection of the major and minor axes of the ellipse) that are respectively located at distances $d_2$ and $d_1$ from the reference axis 354; tilted elliptical conical helical antenna 352B has a base center 360B and a top center 362B that are respectively located at distances $d_2'$ and $d_1'$ from the reference axis 354; tilted elliptical conical helical antenna 352C has a base center 360C and a top center 362C that are respectively located at distances $d_2''$ and $d_1''$ from the reference axis 354; and tilted elliptical conical helical antenna 352D has a base center 360D and a top center 362D that are respectively located at distances $d_2'''$ and $d_1'''$ from the reference axis 354. The distances $d_1$, $d_1'$, d1" and $d_1'''$ are substantially the same and the distances $d_2$, $d_2'$, $d_2''$, and $d_2'''$ are substantially the same. Further, the distances associated with each of the antennas 352A-352D conform to Equation 1. Moreover, because the lateral distances respectively between: (a) the base center 360A and the top center 362A of the antenna 352A ($d_2-d_1$), (b) the base center 360B and the top center 362B of the antenna 352B ($d_2'-d_1'$), (c) base center 360C and the top center 362C of the antenna 352C ($d_2''-d_1''$), and (d) base center 360D and the top center 362D of the antenna 352D ($d_2'''-d_1'''$) are substantially the same, the tip angles θ associated with each the antennas 352A-352D are also substantially the same. To feed the antennas 352A-352D in phase, the ends 364A-364D of the electrical conductors of the antennas are respectively located adjacent to the elliptical planar base surfaces 356A-356D of each of the antennas and at the same azimuthal angle φ relative to the base center 360A-360D of the relevant antenna. The locations of the ends 364A-364D of the electrical conductors for in phase feeding of the antennas 352A-352D renders the electrical conductor for each of the antennas 352A-352D structurally unique relative to one another.

The need for structurally unique electrical conductors in a two-dimensional array of elliptical helical antennas with two or more of the antennas equidistant from a reference axis can be substantially reduced by incorporating phase shifters into the antennas that are equidistant from the reference axis. With reference to FIG. 4G, a two-dimensional array of elliptical helical antennas 400 comprised of four tilted elliptical conical helical antennas 402A-402D that are each equidistant from a reference axis 404 is described. The tilted elliptical conical helical antennas 402A, 402C are modeled on a first frustum of an oblique elliptical cone and tilted helical antennas 402B, 402D are modeled on a second frustum of an oblique elliptical cone. The antennas 402A-402D respectively have elliptical planar base surfaces 406A-406D that lie in a plane that is spaced from and parallel to a ground plane (not shown), elliptical planar top surfaces 408A-408D that are each substantially parallel to the corresponding one of the elliptical planar base surfaces 406A-406D, and a height "h". Each of the frustums is such that: (a) the major axis of each of the elliptical planar base surfaces 406A-406D is substantially parallel to the major axis of the corresponding one of the elliptical planar top surfaces 408A-408D and (b) the minor axis of each of the elliptical planar base surfaces 406A-406D is substantially parallel to the minor axis of the corresponding one of the elliptical planar top surfaces 408A-408D. Each of antennas 402A-402D is situated such that: (a) the major axes associated with the base and top elliptical planar surfaces of each antenna are parallel to the major axes associated with the base and top elliptical planar surfaces of each of the other antennas and (b) the minor axes associated with the base and top elliptical planar surface of each antenna are parallel to the minor axes associate with the base and top elliptical planar surfaces of each of the other antennas. The tilt angle θ of each of the cones is the same due to each of the antennas 402A-402D being located at substantially the same distance from the reference axis 404. More specifically, tilted elliptical conical helical antenna 402A has a base center 410A (i.e., the intersection of the major and minor axes of the ellipse) and a top center 412A (i.e., the intersection of the major and minor axes of the ellipse) that are respectively located at distances $d_2$ and $d_1$ from the reference axis 404; tilted elliptical conical helical antenna 402B has a base center 410B and a top center 412B that are respectively located at distances $d_2'$ and $d_1'$ from the reference axis 404; tilted elliptical conical helical antenna 402C has a base center 410C and a top center 412C that are respectively located at distances $d_2''$ and $d_1''$ from the reference axis 404; and tilted elliptical conical helical antenna 402D has a base center 410D and a top center 412D that are respectively located at distances $d_2'''$ and $d_1'''$ from the reference axis 404. The distances $d_1$, $d_1'$, d1" and $d_1'''$ are substantially the same and the distances $d_2$, $d_2'$, $d_2''$, and $d_2'''$ are substantially the same. Further, the distances associated with each of the antennas 402A-402D conform to Equation 1. Moreover, because the lateral distances respectively between: (a) the base center 410A and the top center 412A of the antenna 402A ($d_2-d_1$), (b) the base center 410B and the top center 412B of the antenna 402B ($d_2'-d_1'$), (c) base center 410C and the top center 412C of the antenna 402C ($d_2''-d_1''$), and (d) base center 410D and the top center 412D of the antenna 402D ($d_2'''-d_1'''$) are substantially the same, the tip angles θ associated with each the antennas 402A-402D are also substantially the same.

The location of the ends 414A-314D of the electrically conductive wire associated each of the antennas 402A-402D renders the electrically conductive wires associated with antennas 402A, 402C substantially identical to one another and the electrically conductive wire associated with antennas 402B, 402D substantially identical to one another. However, the end 414C is rotated 180° relative to end 364C (See FIG. 4F) and the end 414D is rotated 180° relative to the end 364D (See FIG. 4F). Without more, these 180° shifts in the locations for the ends 414C and 414D relative to the locations of ends 364C and 364 of antenna 350 will result in the antennas 402A-402D being out of phase with one another. However, this out of phase issue can be addressed by incorporating phase shifters into the antennas 402C, 402D. Specifically, a 180° phase shifter 416C is incorporated into antenna 402C and a 180° phase shifter 416D is incorporated into antenna 402D. For clarity, 0° phase shifters 416A, 416 have been respectively incorporated into antennas 402A, 402B.

Arrays of tilted conical helical antennas disposed over three-dimensional surfaces are also feasible and constructed in accordance with the foregoing teachings concerning one dimensional and two-dimensional arrays. The distances indicated previously as $d_1$ and $d_2$ were described as parallel to a planar surface. In a three dimensional array, these distance are now measured equidistant from the three-dimensional surface.

Figure 4H:
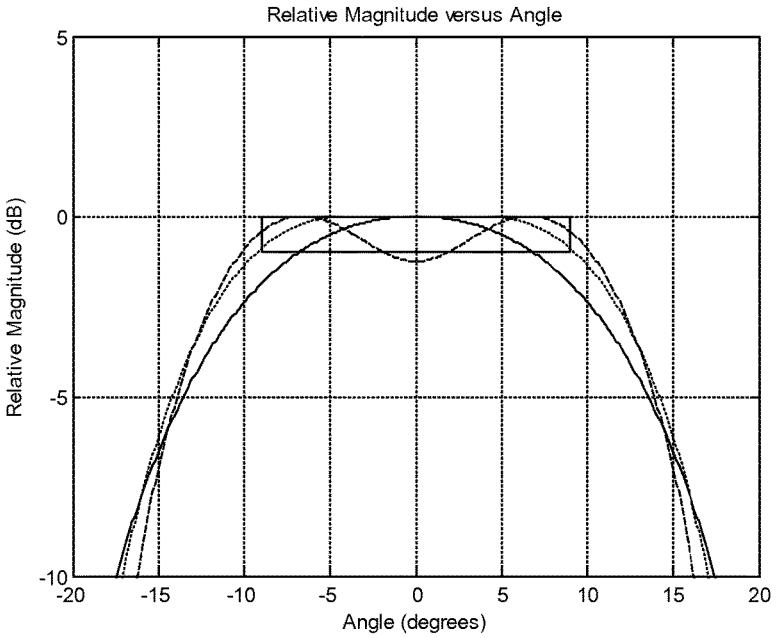
FIG. 4H illustrates the antenna radiation pattern over frequency for an array of right circular helical antennas.
Figure 4I:
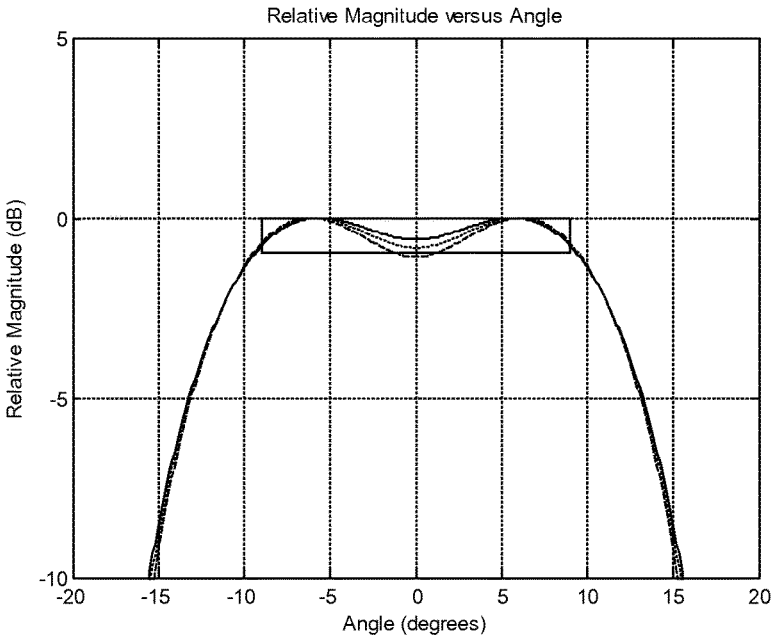
FIG. 4I illustrates the antenna radiation pattern over frequency for an array of tilted circular helical antennas.

With reference to FIGS. 4H and 4I, the improvements in gain and pattern uniformity realized with an array of tilted conical helical antennas relative to an array of right conical helical antennas are discussed. FIG. 4H illustrates the patterns at low, medium, and high frequencies within the operating band for an array of right circular helical antennas. The three patterns vary significantly over frequency. With reference to FIG. 4I, the patterns at low, medium, and high frequencies for an array of tilted circular helical antennas with the same operating band as the array of right circular helical antennas is illustrated. A comparison of the patterns for the array of tilted circular helical antennas to the patterns for the array of right circular helical antennas reveals that the array of tilted circular helical antennas has relatively little variation in pattern shape and gain at each point in the pattern cut relative to the array of right circular helical antennas. While the benefits of noted with respect to FIG. 4I relate to an array of tilted conical helical antennas, comparable benefits are obtained if the array incorporates a right elliptical (including circular) conical helical antenna located at the reference axis.

The various arrays of conical helical antennas described herein that include at least one tilted conical helical antenna have described the antennas as have a single arm, i.e., a single electrical conductor that follows a helical path on the lateral surface of a cone. It should be appreciated that right and tilted conical helical antennas for use in such arrays can be multi-arm antennas that may or may not be employ a ground plane.

Figure 6:
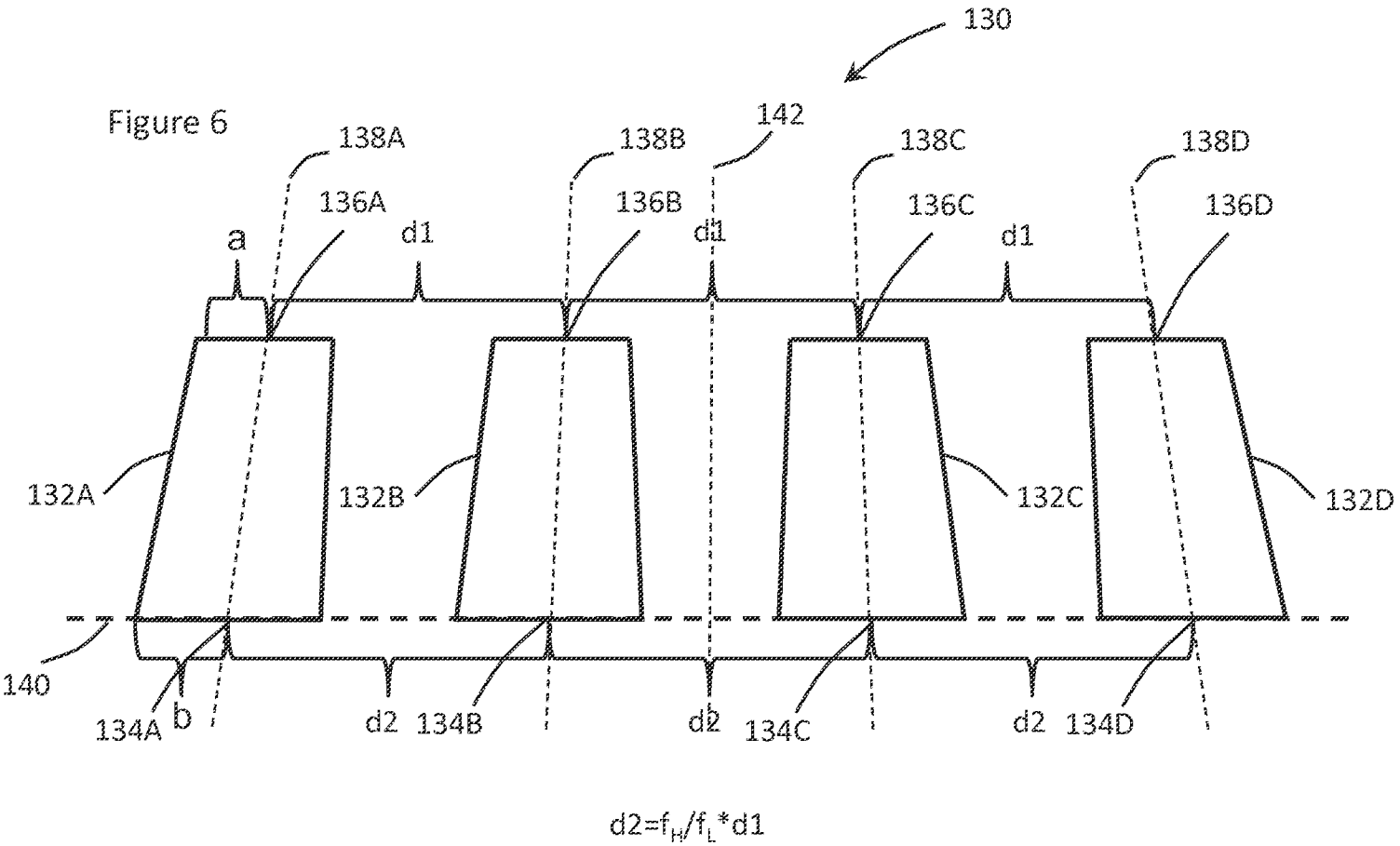
FIG. 6 illustrates a linear antenna array comprised of four tipped conical helical antennas in which the angles of the two outer antennas in the array are tipped more towards phase center axis than the two inner antennas.

It should be appreciated that other reference locations can be utilized. For instance, the axis of the frustum associated with one conical helical antenna in the array can be used to determine the distances to the planar base center and planar top center of other tipped conical helical antennas in the array and the angle of the axis of each of these antennas relative to the relevant planar base surface for each of these antennas. FIG. 6 illustrates a linear antenna array of tilted conical helical antennas 130. The antenna array 130 comprises four tilted conical helical antennas 132A-132D that are respectively modeled on frustums that have: (a) planar base surfaces with planar base centers 134A-134D and radiuses of "b", (b) planar top surfaces with planar top centers 136A-136D and radiuses of "a", and (c) axes 138A-138D. Further, each of the planar base surfaces of the frustums on which each of the antennas 132A-132D is modeled lies in a plane 140. For clarity, the ground plane is omitted from the drawing. The antenna array 130 has a phase center axis 142. The antennas 132A-132D are positioned such that the distance between consecutive planar base centers is d2' and the distance between consecutive planar top centers is d1'. Regardless of whichever one of the axes is used as a reference location, this spacing satisfies equation (1). Additionally, the angle that each of the axes 138A-138D makes relative to its planar base surface or plane 140 can be determined according to equation (2), where for each of antennas 132A-132D, the distance "d1" is distance of the relevant one of the planar top centers 136A-136D from the phase center axis 142 and the distance "d2" is the distance of the relevant one of the planar base centers 134A-134D from the phase center axis 142. Relative to the phase center axis 142, this angle decreases with increasing distance from the phase center axis 142. In this regard, the angles of the axes 138A and 138D relative to plane 140 and respectively associated with antennas 132A and 132D are less than the angles of the axes 138B and 138C relative to plane 140 and respectively associated with antennas 132B and 132C.

The foregoing description of the invention is intended to explain the best mode known of practicing the invention and to enable others skilled in the art to utilize the invention in various embodiments and with the various modifications required by their particular applications or uses of the invention.

What is claimed is:

1. An array of conical helical antennas comprising:

a first conical helical antenna that includes a first electrically conductive structure that follows a first conical helical path; and a second conical helical antenna disposed adjacent to the first conical helix antenna;

wherein the second conical helical antenna includes a second electrically conductive structure that follows a second conical helical path;

wherein the second conical helical antenna is a tilted conical helical antenna;

wherein the second electrically conductive structure of the second conical helical antenna is modeled on a frustum of an oblique elliptical cone having: (a) a planar elliptical base surface, (b) a planar elliptical top surface that is substantially parallel to the planar elliptical base surface and is of a lesser extent relative to the planar elliptical base surface, (c) the major axes of the planar elliptical base and top surfaces being substantially parallel to one another, (d) the minor axes of the planar elliptical base and top surfaces being substantially parallel to one another, (e) a height "h" that is the perpendicular distance between the planar elliptical base and top surfaces, (f) a lateral surface extending between the planar elliptical top and base surfaces, (g) a tilt axis extending through a base intersection of the major and minor axes of the planar elliptical base surface and a top intersection of the major and minor axes of the planar elliptical top surface, and (h) a tip angle between planar elliptical base surface and the tip axis that is not 90°;

wherein the base intersection is a first distance $d_2$ from a reference axis for the array;

wherein the top intersection is a second distance $d_1$ from the reference axis;

wherein $d_1$ is less than $d_2$;

wherein the ratio of $d_1/d_2$ is substantially equal to $f_l/f_h$, where $f_l$ is the low frequency and $f_h$ is the high frequency of the bandwidth of the second conical helical antenna; and wherein the first conical helical path followed by the first electrically conductive structure has one of a right-hand character and a left-hand character;

wherein the second conical helical path followed by the second electrically conductive structure has the same one of a right-hand character and left-hand character and the first conical helical path.

2. An array of conical helical antennas, as claimed in claim 1, wherein:

the second electrically conductive structure includes an electrically conductive wire that follows a helical path along the lateral surface of the oblique elliptical cone on which the second conical helical antenna is modeled.

3. An array of conical helical antennas, as claimed in claim 1, wherein:

the tip angle of the second conical helical antenna is $\tan^{-1}(h/(d_2-d_1))$.

4. An array of conical helical antennas, as claimed in claim 1, wherein:

the frustum of an oblique elliptical cone is a frustum of an oblique circular cone such that: (a) the planar elliptical base and top surfaces are planar circular base and top surfaces, (b) the major and minor axes of the planar elliptical base surface are of substantially equal length to one another, (c) the major and minor axes of the planar elliptical top surface are of substantially equal length to one another, (d) the base intersection is the center of the planar elliptical base surface, (e) the top intersection is the center of the planar elliptical top surface, and (f) the tilt axis passes through the centers of the planar elliptical base and top surfaces.

5. An array of conical helical antennas, as claimed in claim 1, further comprising:

a ground plane.

6. An array of conical helical antennas, as claimed in claim 1, wherein:

each of the first and second conical helical antennas has an equal number of multiple arms.

7. An array of conical helical antennas, as claimed in claim 1, wherein:

the first conical helical antenna is a tilted conical helical antenna.

8. An array of conical helical antennas, as claimed in claim 1, wherein:

the first conical helical antenna is a right conical helical antenna.

9. An array of conical helical antennas, as claimed in claim 8, wherein:

the reference axis is collinear with a tilt axis of a frustum of a right elliptical cone upon which the first electrically conductive structure of the first conical helical antenna is modeled.

10. An array of conical helical antennas, as claimed in claim 1, wherein:

the reference axis is substantially perpendicular to the planar elliptical base and top surfaces of the frustum of an oblique elliptical cone upon which the second electrically conductive structure is modeled.

11. An array of conical helical antennas comprising:

a first conical helical antenna;

wherein the first conical helical antenna includes a first electrically conductive structure that follows a first conical helical path that has one of a right-hand character and a left-hand character;

wherein the first conical helical antenna is a right conical helical antenna in which the first electrically conductive structure is modeled on a frustum of a right elliptical cone having: (a) a first planar elliptical base surface, (b) a first planar elliptical top surface that is substantially parallel to the first planar elliptical base surface and is of a lesser extent relative to the first planar elliptical base surface, (c) the major axes of the first planar elliptical base and top surfaces being substantially parallel to one another, (d) the minor axes of the first planar elliptical base and top surfaces being substantially parallel to one another, (e) a first height "$h_1$" that is the perpendicular distance between the first planar elliptical base and top surfaces, (f) a first lateral surface extending between the first planar elliptical top and base surfaces, (g) a first tilt axis extending through a first base intersection of the major and minor axes of the first planar elliptical base surface and a first top intersection of the major and minor axes of the first planar elliptical top surface, and (h) a first tip angle between the first planar elliptical base surface and the first tip axis that is substantially 90°;

a second conical helical antenna disposed adjacent to the first conical helix antenna;

wherein the second conical helical antenna includes a second electrically conductive structure that follows a second conical helical path that has the same one of a right-hand character and left-hand character as the first conical helical path;

wherein the second conical helical antenna is a tilted conical helical antenna in which the second electrically conductive structure is modeled on a frustum of an oblique elliptical cone having: (a) a second planar elliptical base surface, (b) a second planar elliptical top surface that is substantially parallel to the second planar elliptical base surface and is of a lesser extent relative to the second planar elliptical base surface, (c) the major axes of the second planar elliptical base and top surfaces being substantially parallel to one another, (d) the minor axes of the second planar elliptical base and top surfaces being substantially parallel to one another, (e) a second height "$h_2$" that is the perpendicular distance between the second planar elliptical base and top surfaces, (f) a second lateral surface extending between the planar elliptical top and base surfaces, (g) a second tilt axis extending through a second base intersection of the major and minor axes of the second planar elliptical base surface and a second top intersection of the major and minor axes of the second planar elliptical top surface, and (h) a second tip angle between the second planar elliptical base surface and the second tip axis that is not 90°;

the second base intersection is a first distance $d_2$ from the first tilt axis for the array;

the second top intersection is a second distance $d_1$ from the first tilt axis;

the ratio of $d_1/d_2$ is substantially equal to $f_l/f_h$, where $f_l$ is the low frequency and $f_h$ is the high frequency of the bandwidth of the second conical helical antenna; and wherein $d_1$ is less than $d_2$.

12. An array of conical helical antennas, as claimed in claim 11, wherein:

the second tip angle of the second conical helical antenna is $\tan^{-1}(h/(d_2-d_1))$.

13. An array of conical helical antennas, as claimed in claim 11, further comprising:

a ground plane.

14. An array of tilted conical helical antennas, as claimed in claim 11, wherein:

at least one of the first and second conical helical antennas includes a phase shifter.

15. An array of conical helical antennas, as claimed in claim 11, wherein:

the first planar elliptical base and top surfaces of the frustum of the right elliptical cone upon which the first electrically conductive structure is modeled are substantially parallel to the second planar elliptical base and top surfaces of the oblique elliptical cone upon which the second electrically conductive structure is modeled;

the major and minor axes of the first elliptical base and top surfaces of the frustum of the right elliptical cone upon which the first electrically conductive structure is modeled are substantially parallel to the major and minor axes of the second planar elliptical base and top surfaces of the oblique elliptical cone upon which the second electrically conductive structure is modeled; and the reference axis is substantially perpendicular to the first planar elliptical base and top surfaces of the frustum of the right elliptical cone upon which the first electrically conductive structure is modeled and to the second planar elliptical base and top surfaces of the oblique elliptical cone upon which the second electrically conductive structure is modeled.

16. An array of tilted conical helical antennas comprising:

a first tilted conical helical antenna located a first distance from a reference axis associated with the array;

wherein the first conical helical antenna includes a first electrically conductive structure that follows a first conical helical path that has one of a right-hand character and a left-hand character;

the first electrically conductive structure of the second conical helical antenna is modeled on a first frustum of an oblique elliptical cone having: (a) a planar elliptical base surface, (b) a planar elliptical top surface that is substantially parallel to the planar elliptical base surface and is of a lesser extent relative to the planar elliptical base surface, (c) the major axes of the planar elliptical base and top surfaces being substantially parallel to one another, (d) the minor axes of the planar elliptical base and top surfaces being substantially parallel to one another, (e) a height "h" that is the perpendicular distance between the planar elliptical base and top surfaces, (f) a lateral surface extending between the planar elliptical top and base surfaces, (g) a tilt axis extending through a base intersection of the major and minor axes of the planar elliptical base surface and a top intersection of the major and minor axes of the planar elliptical top surface, and (h) a first tip angle between planar elliptical base surface and the tip axis that is not 90°;

a second tilted conical helical antenna located a second distance from the reference axis;

wherein the second conical helical antenna includes a second electrically conductive structure that follows a second conical helical path and that has the same one of a right-hand character and left-hand character as the first conical helical path;

the second electrically conductive structure of the second conical helical antenna is modeled on a second frustum of an oblique elliptical cone having: (a) a planar elliptical base surface, (b) a planar elliptical top surface that is substantially parallel to the planar elliptical base surface and is of a lesser extent relative to the planar elliptical base surface, (c) the major axes of the planar elliptical base and top surfaces being substantially parallel to one another, (d) the minor axes of the planar elliptical base and top surfaces being substantially parallel to one another, (e) a height "h" that is the perpendicular distance between the planar elliptical base and top surfaces, (f) a lateral surface extending between the planar elliptical top and base surfaces, (g) a tilt axis extending through a base intersection of the major and minor axes of the planar elliptical base surface and a top intersection of the major and minor axes of the planar elliptical top surface, and (h) a second tip angle between planar elliptical base surface and the tip axis that is not 90°;

wherein the base intersection of the first oblique elliptical cone is a first distance $d_2$ from a reference axis for the array;

wherein the top intersection of the first oblique elliptical cone is a second distance $d_1$ from the reference axis;

wherein $d_1$ is less than $d_2$;

wherein the base intersection of the second oblique elliptical cone is a third distance $d_4$ from the reference axis for the array;

wherein the top intersection of the second oblique elliptical cone is a fourth distance $d_3$ from the reference axis;

wherein $d_3$ is less than $d_4$.

17. An array of tilted conical helical antennas, as claimed in claim 16, wherein:

the second tip angle is less than the first tip angle.

18. An array of tilted conical helical antennas, as claimed in claim 16, wherein:

the second tip angle is substantially equal to the first tip angle.

19. An array of conical helical antennas, as claimed in claim 16, wherein:

the ratio of $d_1/d_2$ and the ratio of $d_3/d_4$ are each substantially equal to $f_l/f_h$, where $f_l$ is the low frequency and $f_h$ is the high frequency of the bandwidth of the second conical helical antenna.

20. An array of conical helical antennas, as claimed in claim 16, wherein:

the first tilt angle of the first conical helical antenna is $\tan^{-1}(h/(d_2-d_1))$; and the second tilt angle of the second conical helical antenna is $\tan^{-1}(h/(d_4-d_3))$.

21. An array of tilted conical helical antennas, as claimed in claim 16, wherein:

the first electrically conductive structure extends from a first base end to a first top end;

the second electrically conductive structure extends from a second base end to a second top end;

wherein the first base end is located at a first angular position relative to the major and minor axes of the planar elliptical base surface of the first frustum of an oblique elliptical cone and the second base end is located at a second angular position relative to the corresponding major and minor axes of the planar elliptical base surface of the second frustum of an oblique elliptical cone that is different than the first angular position.

22. An array of tilted conical helical antennas, as claimed in claim 16, wherein:

the first electrically conductive structure extends from a first base end to a first top end;

the second electrically conductive structure extends from a second base end to a second top end;

wherein the first base end is located at a first angular position relative to the major and minor axes the planar elliptical base surface of the first frustum of an oblique elliptical cone and the second base end is located at a second angular position relative to the corresponding major and minor axes of the planar elliptical base surface of the second frustum of an oblique elliptical cone that is substantially the same as the first angular position.

23. An array of tilted conical helical antennas, as claimed in claim 22, wherein:

at least one of the first and second tilted conical helical antennas includes a phase shifter.

24. An array of conical helical antennas, as claimed in claim 16, wherein:

the first planar elliptical base and top surfaces of the frustum of the oblique elliptical cone upon which the first electrically conductive structure is modeled are substantially parallel to the second planar elliptical base and top surfaces of the oblique elliptical cone upon which the second electrically conductive structure is modeled;

the major and minor axes of the first elliptical base and top surfaces of the frustum of the oblique elliptical cone upon which the first electrically conductive structure is modeled are substantially parallel to the major and minor axes of the second planar elliptical base and top surfaces of the oblique elliptical cone upon which the second electrically conductive structure is modeled; and the reference axis is substantially perpendicular to the first planar elliptical base and top surfaces of the frustum of the oblique elliptical cone upon which the first electrically conductive structure is modeled and to the second planar elliptical base and top surfaces of the oblique elliptical cone upon which the second electrically conductive structure is modeled.

* * * * *